US009723926B2

(12) United States Patent
Besler et al.

(10) Patent No.: US 9,723,926 B2
(45) Date of Patent: Aug. 8, 2017

(54) ROTATABLE PIECE OF SEATING FURNITURE

(71) Applicants: Boris Besler, Guetersloh (DE); Andreas Hortig, Halle (DE)

(72) Inventors: Boris Besler, Guetersloh (DE); Andreas Hortig, Halle (DE)

(73) Assignee: KINTEC-SOLUTION GMBH, Rietberg (DE)

( * ) Notice: Subject to any disclaimer, the term of this patent is extended or adjusted under 35 U.S.C. 154(b) by 142 days.

(21) Appl. No.: 14/745,965

(22) Filed: Jun. 22, 2015

(65) Prior Publication Data

US 2015/0366351 A1 Dec. 24, 2015

(30) Foreign Application Priority Data

Jun. 23, 2014 (DE) ..... 10 2014 211 962

(51) Int. Cl.
*A47C 1/00* (2006.01)
*A47C 3/18* (2006.01)
(Continued)

(52) U.S. Cl.
CPC ..... *A47C 3/18* (2013.01); *A61G 5/14* (2013.01); *A61G 5/101* (2013.01)

(58) Field of Classification Search
CPC ..... A47C 3/18
(Continued)

(56) References Cited

U.S. PATENT DOCUMENTS 1,275,624 A * 8/1918 Sopwith ..... B61D 33/0085 248/425
2,010,290 A * 8/1935 Campbell ..... A47C 3/285 108/148
(Continued)

FOREIGN PATENT DOCUMENTS

CN 102529756 A 7/2012
DE 25 30 944 A1 1/1977
(Continued)

OTHER PUBLICATIONS

Notification of Transmittal of International Search Report issued in Application No. PCT/EP2015/062977 dated Jul. 20, 2015 (1 page).
(Continued)

*Primary Examiner* — Jose V Chen
(74) *Attorney, Agent, or Firm* — Flynn, Thiel, Boutell & Tanis, P.C.

(57) ABSTRACT

A piece of seating furniture having a base and a seating unit, and a rotary mounting arrangement including a base-side bearing device and a seating-unit-side bearing device via which the seating unit is rotatable with respect to the base, and the rotary mounting arrangement has a switchable blocking device for blocking the rotatability of the bearing devices. The blocking device has two profiles including an inner profile attached to one of the two bearing devices in a rotationally fixed manner, and an outer profile attached to the other of the two bearing devices in a rotationally fixed manner. The outer profile and the inner profile are displaceable with respect to one another such that they are axially movable between an engaging relative position rotationally coupled in a form-fitting manner and a releasing relative position.

7 Claims, 3 Drawing Sheets

(51) Int. Cl.
*A61G 5/14* (2006.01)
*A61G 5/10* (2006.01)

(58) Field of Classification Search
USPC ..... 297/344.1, 344.21, 344.22
See application file for complete search history.

(56) References Cited

U.S. PATENT DOCUMENTS

| | | | | |
|---|---|---|---|---|
| 4,893,871 | A * | 1/1990 | Kowalski | A47C 3/03 248/425 |
| 5,297,849 | A * | 3/1994 | Chancellor | A47C 3/18 297/344.12 |
| 6,361,111 | B1 * | 3/2002 | Bowers | A47C 3/18 297/344.22 |
| 6,877,811 | B1 * | 4/2005 | Garelick | B63B 29/06 248/418 |
| 7,216,840 | B2 * | 5/2007 | Fang | A47C 3/30 248/349.1 |
| 7,575,276 | B1 * | 8/2009 | Henry | B60N 2/2821 297/256.12 |
| 2007/0052271 | A1 * | 3/2007 | Lin | A61G 5/10 297/344.22 |
| 2009/0039692 | A1 * | 2/2009 | Tuckey | A47D 1/008 297/344.22 |
| 2015/0189994 | A1 * | 7/2015 | Lee | A47C 3/18 297/16.1 |
| 2015/0257537 | A1 * | 9/2015 | Besler | A47C 3/185 297/316 |

FOREIGN PATENT DOCUMENTS

| | | | |
|---|---|---|---|
| DE | 80 17 198 | U1 | 2/1981 |
| DE | 20 2012 102 668 | U1 | 4/2013 |
| DE | 10 2014 204 401 | A1 | 9/2015 |
| GB | 2 430 009 | A | 3/2007 |

OTHER PUBLICATIONS

International Search Report issued in Application No. PCT/EP2015/062977 with English translation of categories of documents cited dated Jul. 20, 2015 (4 pages).
Written Opinion of International Searching Authority issued in Application No. PCT/EP2015/062977 dated Jul. 20, 2015 (5 pages).
Office Action of German Patent Office issued in Application No. 10 2014 211 962.6 dated May 5, 2015 (5 pages).

* cited by examiner

ROTATABLE PIECE OF SEATING FURNITURE

CROSS-REFERENCE TO RELATED APPLICATIONS

This application claims the priority of the German patent application DE 10 2014 211 962.6, filed on Jun. 23, 2014, the disclosure of which is hereby incorporated into this application.

FIELD OF APPLICATION AND PRIOR ART

The invention relates to a piece of seating furniture having a base and a seating unit, wherein between the base and the seating unit provision is made of a rotary mounting means comprising a base-side bearing device and a seating-unit-side bearing device by means of which the seating unit is rotatable about a vertical axis relative to the base. In this case, the rotary mounting means has a switchable blocking device by means of which the rotatability of the bearing devices with respect to one another is blockable.

The invention furthermore relates to a fitting for such a piece of seating furniture.

Generic pieces of seating furniture are known from the prior art. These are pieces of seating furniture of which the seating unit is in principle rotatable with respect to a base, wherein the base can be either a stand provided for stationary positioning or a base portion provided with rollers. The latter is well known in particular in pieces of office seating furniture. The rotatability of the seating unit allows the sitter to rotate the seating unit without rotation of the base and thus to take up a sitting position with a modified orientation.

The rotary mounting means, which for this purpose is provided between the base and the seating unit, is, in the case of generic pieces of seating furniture, provided with a blocking device which couples the base and the seating unit together in a given relative rotary position such that a rotary movement is no longer possible or is rendered very difficult.

Said blockability is expedient in particular when the piece of seating furniture is one with stand-up assistance. Such stand-up assistance allows the seating unit to be raised in particular by way of an electric motor such that standing up from the piece of seating furniture is easier. In the standing up phase, rotary movement of the seating unit is generally not desired. Blocking when standing up prevents falling occurring on account of the rotatability of the seating unit.

Known designs for creating a switchable blocking device are comparatively complicated. For example, it has been proposed to create such a blocking device by means of an additional electric motor which can displace a control member into a position in which said control member couples the seating unit and the base together in a form-fitting manner.

In this and other known solutions, however, a disadvantage that can always be noted is that these are associated with quite expensive additional components and to some extent do not make the desired reliability available.

The post-published DE 102014204401 A1 discloses a generic piece of seating furniture in which a frictional connection is realized via a helical spring which can be contracted and expanded in a switchable manner in the circumferential direction. This solution results in the desired functionality but is sometimes difficult to handle during assembly since the expansion of the spring can cause difficulties during assembly.

Generic pieces of seating furniture, in which a Hirth coupling is provided as a lock formed in a face-sided manner on locking plates that come into abutment with one another for locking the rotatability of the bearing devices, are also known.

Problem and Solution

The problem underlying the invention is therefore to develop a generic piece of seating furniture and a fitting for such a piece of seating furniture in such a way that the switchable blocking device is cost-effective and reliable and ensures easy assemblability.

According to the invention, this is achieved in that the blocking device is configured for the form-fitting coupling of the bearing devices. For this purpose, it has two profiles which are pushed into one another if need be in order to be coupled together in a form-fitting manner such that one of the profiles forms an inner profile which is surrounded by the outer profile in this pushed-in relative position. The inner profile and the outer profile are each connected to one of the two bearing devices in a rotationally fixed manner such that, in a state in which they are also coupled together in a rotationally fixed manner, they also couple the two bearing devices and thus also the base and the seating unit together in a rotationally fixed manner.

For the purpose of producing this rotary coupling if need be, the outer profile and the inner profile are displaceable with respect to one another in the direction of the vertical axis such that as a result they are axially movable between an engaging relative position rotationally coupled in a form-fitting manner and a releasing relative position.

In a piece of seating furniture according to the invention, provision is thus made for the axial relative movement of an internal inner profile and an external outer profile to make it possible to change between a rotationally coupled position and a released position. The profiles each have, with respect to their extent in the vertical direction, a constant cross section that differs from a circular shape, wherein the inner cross section of the outer profile and the outer cross section of the inner profile are matched to one another such that they prevent a rotary movement when engaged.

The design with profiles is also advantageous because this allows undemanding coupling. Unlike in the case for example of a Hirth coupling, the rotary coupling is achieved not only in a defined axial end position but is always provided when the profiles are engaged with one another.

The mutually matched specific outer contour of the inner profile and inner contour of the outer profile are realizable in a large variety of ways. Preferably, they are matched to one another such that the rotationally coupled engaging relative position is possible not only in one particular or a few rotary positions of the seating unit relative to the base but in a large number of relative positions, preferably in at least 30 different relative positions. Such a large number of possible engaging relative positions can be realized in a particularly advantageous manner by way of an end toothing. Therefore, in a preferred configuration, the outer profile is configured as an internally toothed outer profile and/or the inner profile is configured as an externally toothed inner profile.

For the purpose of relative movement in the vertical direction of the outer profile and the inner profile in order to establish the engaging relative position and the releasing relative position, provision is preferably made of a switching carrier to which the inner profile or the outer profile is attached. This switching carrier is provided in a permanently rotationally fixed manner on the seating unit or the base, but in particular with respect to the seating unit, but in a displaceable manner in the vertical direction with respect to the seating unit or the base, in particular by means of a sliding guide acting in the vertical direction.

By way of such a design, the switching operation between the engaging relative position and the releasing relative position can take place in that the switching carrier is moved in a vertically guided manner with respect to the component to which it is assigned, in particular with respect to the seating unit, and in this case passes into engagement or out of engagement with the other profile.

In order to make the displacement of the switching carrier particularly easy, provision is preferably made of a spring device by means of which the switching carrier is subjected permanently to a force in the direction of a first end position. For the purpose of the movement in the opposite direction, provision is made of a force-introduction surface on the switching carrier or on the part connected thereto, the switching carrier being able to be subjected to a force counter to the force of the spring device in the direction of an opposite second end position by means of said force-introduction surface.

In this case, one of the end positions, preferably the first end position of the switching carrier, which can be formed by a stop or the like, is preferably provided such that in this end position the outer profile or the inner profile are arranged in the rotationally coupled engaging relative position. In such a configuration, the spring device thus has the effect that the discontinuation of force introduction at the force-introduction surface establishes the rotationally coupled state of the profiles, while, in order to release the profiles and to achieve the releasing relative position, force introduction at the force-introduction surface is necessary.

However, a configuration in which force introduction at the force-introduction surface is required in order to establish the rotationally coupled state, while, in the event of discontinuation of such a force, the spring device automatically effects displacement of the profiles into the releasing relative position, is also possible and, depending on the configuration of the piece of seating furniture, expedient.

It is particularly advantageous for the piece of seating furniture to have a stand-up assistance function by way of which a seating surface on the seating unit can be raised. In this case, the blocking device is preferably operatively coupled to this stand-up assistance such that when the stand-up assistance function is actuated it takes up its blocked state, i.e. the profiles pass into the rotationally coupled engaging relative position. This can be achieved in particular in that, by activating the stand-up assistance function, application of force to the force-introduction surface is brought about or dispensed with. It is particularly advantageous for an actuating portion on the seating unit to be spaced apart from the force-introduction surface on the switching carrier by activation of the stand-up assistance function, and therefore to allow the switching carrier to be displaced in the direction of the first end position as a result of the application of force by the spring device.

Alternatively or in addition, provision can be made for the piece of seating furniture to have an operating lever for manual actuation, the blocking device being switchable by means of said operating lever, in particular by axial displacement of the switching carrier. Thus, the seating unit can also be locked in a desired rotary position with respect to the base independently of a possibly provided stand-up assistance function.

The invention furthermore relates to a fitting for a piece of seating furniture, said fitting having the fitting-specific features as per the above-described piece of seating furniture and optionally as per the aspects described as being optional.

BRIEF DESCRIPTION OF THE DRAWINGS

Further aspects and advantages of the invention can be gathered from the claims and the following description of a preferred exemplary embodiment of the invention, said exemplary embodiment being explained with reference to the figures, in which:

DETAILED DESCRIPTION OF THE EXEMPLARY EMBODIMENTS

Figure 1A:
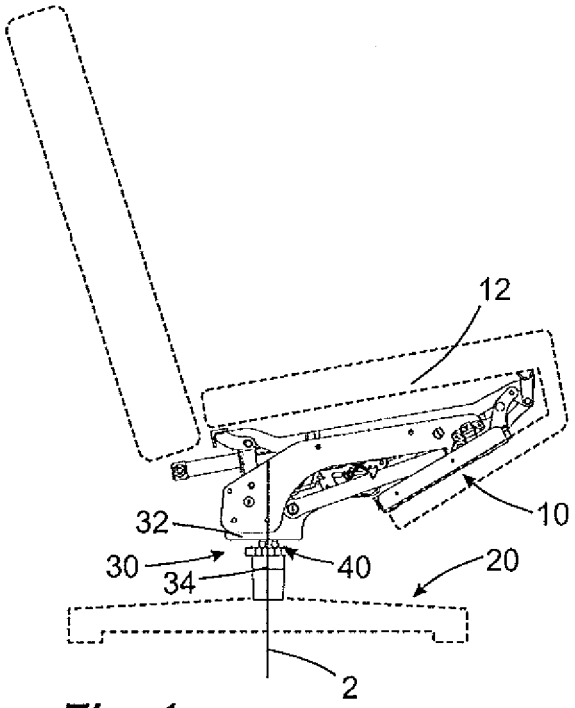
FIGS. 1*a* and 1*b* show a perspective view and a side view of a piece of seating furniture according to the invention in a use state.
Figure 1B:
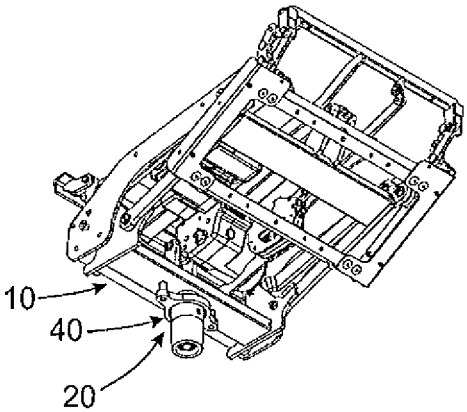

FIG. 1*a* shows a piece of seating furniture according to the invention, wherein components that are subordinate in connection with the present invention are indicated merely by way of dashed lines.

The piece of seating furniture has a base 20 for the purpose of positioning the piece of seating furniture. It also has a seating unit 10, which is arranged above the base 20 and provides a seating surface 12. The seating unit 10 is rotatable about a rotation axis 2 with respect to the base. To this end, it has a rotary mounting means 30 having a seat-side bearing device 32 and a base-side bearing device 34. Assigned to the rotary mounting means 30 is a blocking device 40, by way of which the rotatability of the seating unit 10 with respect to the base 20 can be prevented, as is explained further below.

The particularity of the exemplary embodiment is in particular that the piece of seating furniture has a stand-up assistance function. This is explained by way of FIG. 2*a*. Provided on a lower fitting portion 20*a*, which also comprises the seating-unit-side bearing device 32, as will be described further below, are two links 22*a*, 22*b* which connect the segment 20*a* to a segment 24 on which the seating surface 12 is provided. By way of an electric motor, it is possible to introduce force into these links 22*a*, 22*b*, with the result that these are subjected to force such that the segment 24 together with the seating surface 12 is raised. This makes it easier for a person sitting on the piece of seating furniture to stand up.

Figure 2A:
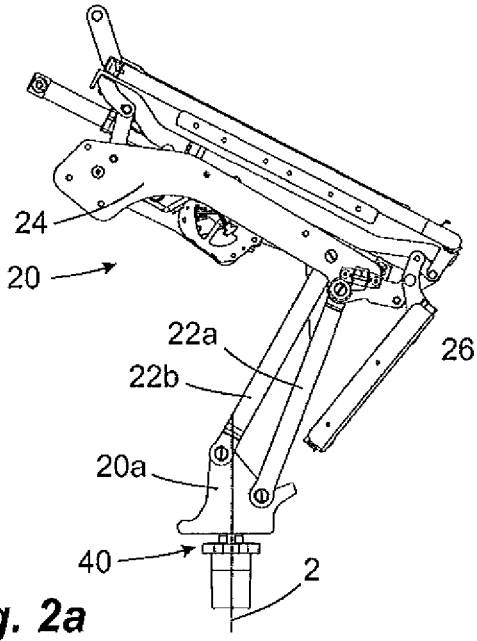
FIGS. 2*a* and 2*b* show a perspective view and a side view of the piece of seating furniture from FIGS. 1*a* and 1*b* in a raised state for easier standing up.
Figure 2B:
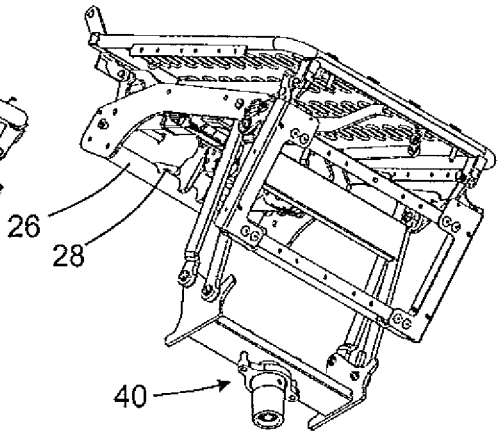

In particular in connection with such a functionality, the presence of the blocking device 40 is expedient, since, during standing up, i.e. in the state in FIGS. 2*a* and 2*b*, rotatability of the seating unit 10 about the axis 2 with respect to the base 20 is not desired.

FIGS. 3*a*, 3*b*, 4*a* and 4*b* show how the blocking device 40 is configured and is operatively coupled to the stand-up assistance illustrated in FIGS. 2*a* and 2*b*.

Figure 3A:
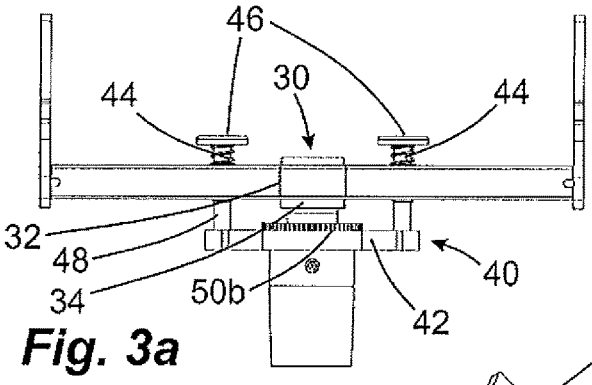
FIGS. 3*a* and 3*b* show the rotary mounting means of the piece of seating furniture together with the blocking device in the use state.
Figure 3B:
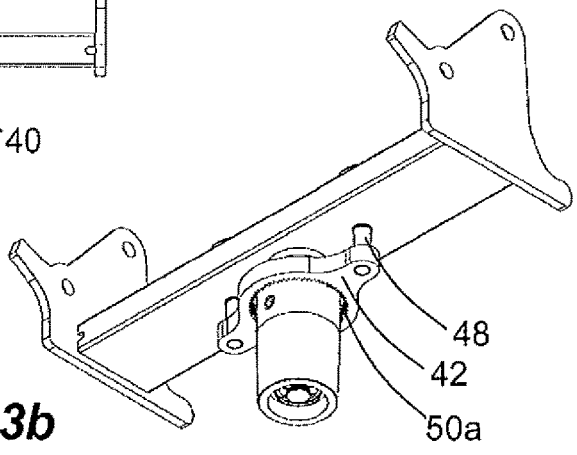

FIG. 3*a* shows a front view of the rotary mounting means 30 and the blocking device 40. FIG. 3*b* shows the components in a perspective view obliquely from below.

Located on the seating-unit 12 side is said fitting element 20*a*, which has a cross member that connects two side plates, said cross member at the same time forming the seating-unit-side bearing device 32. Provided on the base 20 side, in a manner corresponding hereto, is the base-side bearing device 34 of the rotary mounting means 30.

Furthermore, provided on the base 20 side is an externally toothed profile portion 50*b*, which is connected in a rotationally fixed manner to the base 20 and is thus not rotatable with respect to the latter. The column-like portion of the base 20, on which this toothing profile 50*b* is provided, is surrounded by a switching carrier 42. This switching carrier 42 is guided by means of two sliding segments 48 with respect to the cross member of the seating-element-side fitting segment 20*a*. Provided at the opposite ends of the sliding segments are approximately mushroom-like widenings, the top sides of which represent the force-introduction surfaces 46. These are subjected to a force from below by means of two spring devices 44 in the manner of helical springs. These spring devices 44 are supported by way of their downwardly directed ends on the cross member of the fitting segment 22*a*. As a result, as long as there is no further application of force at the force-introduction surfaces 44, the switching carrier 42 is pushed permanently upwards.

However, in the state in FIGS. 3*a* and 3*b*, there is application of force at the force-introduction surfaces 46 in a manner which is not illustrated. This is caused, with reference to FIG. 2*b*, by portions on the fitting segment 24, in the present case by extensions 28 on a crossbar 26 of the fitting portion 24. The springs 44 are thus held in the compressed state in the state in FIGS. 3*a* and 3*b*. The switching carrier 42 is, as a result, in a bottom end position and an internally toothed outer profile 50*a* on the switching carrier 42 is consequently disengaged from the externally toothed inner profile 50*b*. Thus, in the state in FIGS. 3*a* and 3*b*, the blocking device 40 is not active. The seating unit 10 can be rotated with respect to the base 20.

Figure 4A:
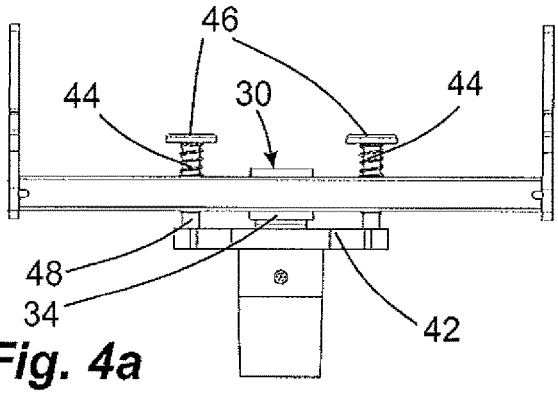
FIGS. 4*a* and 4*b* show the rotary mounting means of the piece of seating furniture together with the blocking device in the raised state of the piece of seating furniture.
Figure 4B:
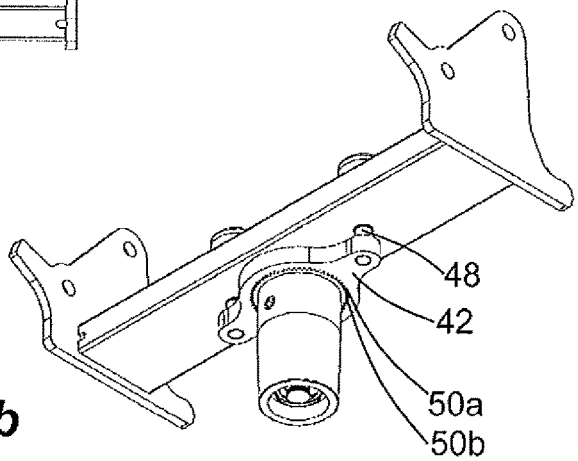

If the application of force at the force-introduction surfaces 46 is dispensed with, the state in FIGS. 4*a* and 4*b* is established. As a result of the discontinuation of the application of force, the force-introduction surfaces 46 are pushed upwards by the spring devices 44 and thus also pull the switching carrier 42 upwards. As a result, the internally toothed profile 50*a* of the latter comes into engagement with the base-side profile 50*b* that is not carried along in the vertical direction. On account of the large number of teeth, of which there are about 60, this engaging position can be achieved with at most minimal change in the relative rotary position of the seating unit 10 with respect to the base 20. In order to make it easier to establish the engaging state, each of the toothings or one of the toothings can be provided with teeth which have lead-in chamfers.

The discontinuation of the application of force at the force-introduction surfaces 46 is brought about by the portions, previously acting thereon, on the extensions 28 being raised during the activation of the stand-up assistance function, in a manner that can be readily seen from FIG. 2*b*. Blocking thus arises inevitably from the activation of the stand-up assistance function.

Figure 5:
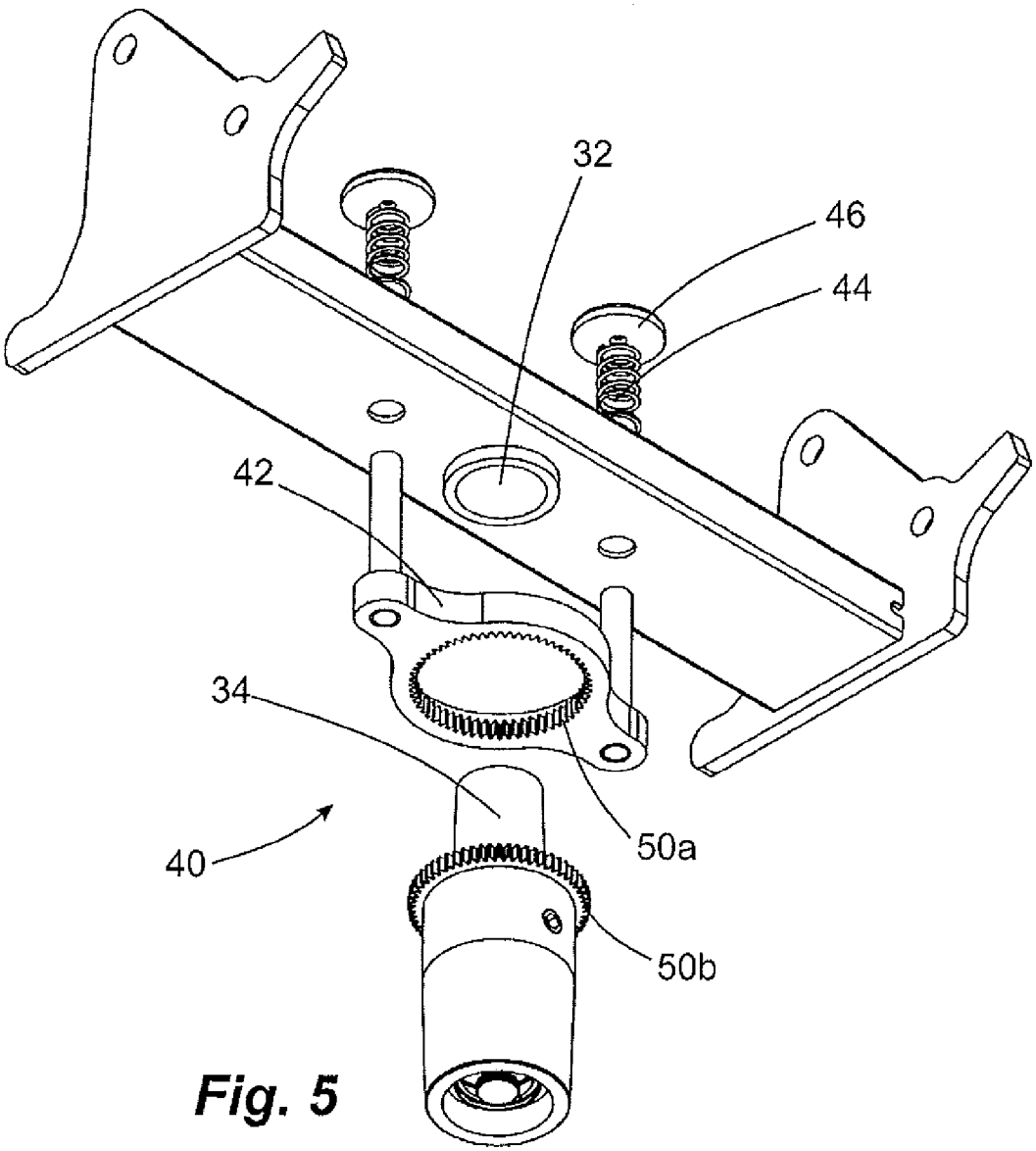
FIG. 5 shows an exploded illustration of the rotary mounting means together with the blocking device.

The most essential components, in the context of the invention, of the rotary mounting means 30 and in particular of the blocking device 40 are illustrated once again in an exploded illustration in FIG. 5.

The invention claimed is:

1. Piece of seating furniture comprising:

a base; and a seating unit;

wherein between the base and the seating unit provision is made of a rotary mounting means comprising a base-side bearing device and a seating-unit-side bearing device by means of which the seating unit is rotatable about a vertical axis relative to the base;

wherein the rotary mounting means has a switchable blocking device by means of which rotatability of the bearing devices with respect to one another is blockable;

wherein the blocking device is configured for form-fitting coupling of the bearing devices and has two profiles comprising an inner profile which is attached to a first one of the bearing devices in a rotationally fixed manner and an outer profile which is attached to a second one of the bearing devices in a rotationally fixed manner;

wherein the outer profile and the inner profile are displaceable with respect to one another in a direction of the vertical axis such that the outer profile and the inner profile are axially movable between an engaging relative position rotationally coupled in a form-fitting manner and a releasing relative position; and wherein the piece of seating furniture has a stand-assistance function by way of which a seating surface can be raised, wherein the blocking device is operatively coupled to the stand-up assistance function such that when the stand-up assistance function is actuated, the blocking device takes up a blocked state in that application of force to a force-introduction surface is brought about or dispensed with by activation of the stand-up assistance function.

2. Piece of seating furniture according to claim 1, wherein:

one of the profiles is provided on a switching carrier that is rotationally fixed relative to the seating unit or to the base, said switching carrier being displaceable in a manner guided in the direction of the vertical axis with respect to the seating unit or the base, respectively.

3. Piece of seating furniture according to claim 2, further comprising:

a spring device which is configured to permanently subject the switching carrier to a force in a direction of a first end position;

wherein the force-introduction surface is on the switching carrier or a part connected thereto, the switching carrier being able to be subjected to a force counter to the force of the spring device in a direction of a second end position by means of said force-introduction surface.

4. Piece of seating furniture according to claim 2, wherein:

the piece of seating furniture has an operating lever for manual actuation, the blocking device being switchable by means of said operating lever by axial displacement of the switching carrier.

5. Piece of seating furniture according to claim 2, wherein:

the outer profile is provided in a rotationally fixed manner relative to the seating-unit-side bearing device, wherein the switching carrier is provided in a rotationally fixed manner relative to the seating-unit-side bearing device; and the inner profile is provided in a rotationally fixed manner relative to the base-side bearing device.

6. Piece of seating furniture according to claim 1, wherein:

the outer profile and the inner profile can be brought from the releasing relative position into the engaging relative position in a plurality of relative rotary positions, wherein the outer profile is configured as an internally toothed outer profile and the inner profile is configured as an externally toothed inner profile.

7. Fitting for a piece of seating furniture, comprising:

a base portion for attaching to a base of the piece of seating furniture; and a seat portion for attaching to a seating unit of the piece of seating furniture;

wherein between the base portion and the seat portion provision is a rotary mounting means comprising a base-side bearing device and a seating-unit-side bearing device by means of which the seat portion is rotatable about a vertical axis with respect to the base portion;

wherein the rotary mounting means is provided with a switchable blocking device by means of which rotatability of the bearing devices with respect to one another is blockable;

wherein the blocking device is configured for form-fitting coupling of the bearing devices and has two profiles comprising an inner profile which is attached to a first one of the bearing devices in a rotationally fixed manner and an outer profile which is attached to a second one of the bearing devices in a rotationally fixed manner;

wherein the outer profile and the inner profile are displaceable with respect to one another in a direction of the vertical axis such that the outer profile and the inner profile are axially movable between a rotationally coupled engaging relative position and a releasing relative position; and wherein the piece of seating furniture has a stand-up assistance function by way of which a seating surface can be raised, wherein the blocking device is operatively coupled to the stand-up assistance function such that when the stand-up assistance function is actuated, the blocking device takes up a blocked state in that application of force to a force-introduction surface is brought about or dispensed with by activation of the stand-up assistance function.

* * * * *